US007798384B2

(12) United States Patent
Paske

(10) Patent No.: US 7,798,384 B2
(45) Date of Patent: Sep. 21, 2010

(54) PROBE BAR HOLE DRIVER AND REMOVER

(75) Inventor: Benjamin J. Paske, Slinger, WI (US)

(73) Assignee: M-B-W, Inc., Slinger, WI (US)

( * ) Notice: Subject to any disclaimer, the term of this patent is extended or adjusted under 35 U.S.C. 154(b) by 124 days.

(21) Appl. No.: 12/240,297

(22) Filed: Sep. 29, 2008

(65) Prior Publication Data

US 2010/0078460 A1 Apr. 1, 2010

(51) Int. Cl.
*B25C 7/00* (2006.01)
*B23B 45/06* (2006.01)

(52) U.S. Cl. ..... 227/15; 227/153; 173/128; 173/90; 254/27; 254/30

(58) Field of Classification Search ..... 173/90, 173/91, 128, 211; 227/15, 18, 147, 139, 227/141, 153; 254/21, 19, 27, 25, 255, 263, 254/275, 3
See application file for complete search history.

(56) References Cited

U.S. PATENT DOCUMENTS 654,001 A * 7/1900 Hull ..... 254/132
1,916,463 A * 7/1933 Carrel ..... 254/132
3,991,976 A * 11/1976 Skinner ..... 254/30
4,098,360 A 7/1978 Clements
4,106,576 A * 8/1978 Clements ..... 175/313
4,310,057 A * 1/1982 Brame ..... 175/21
4,335,622 A * 6/1982 Bartz ..... 73/864.74
4,378,650 A * 4/1983 Ottoson ..... 40/607.08
4,726,565 A * 2/1988 Keller ..... 254/30
4,790,392 A * 12/1988 Clements ..... 175/20
4,804,050 A * 2/1989 Kerfoot ..... 175/20
4,998,312 A * 3/1991 Donaldson ..... 7/166
5,022,632 A * 6/1991 Beideck ..... 254/30
5,186,437 A * 2/1993 Scott ..... 254/30
5,224,687 A * 7/1993 Geckler et al. ..... 254/30
5,261,642 A * 11/1993 Stambaugh ..... 254/30
5,462,126 A 10/1995 Wallace
5,833,215 A * 11/1998 Vandenburg ..... 254/30
6,854,531 B2 * 2/2005 Jubinville ..... 173/90
6,978,983 B1 * 12/2005 Sclease et al. ..... 254/30
7,059,587 B1 * 6/2006 Fimple ..... 254/30

OTHER PUBLICATIONS

Health Consultants, Plunger Bars, Maximum Performance Probes; Nov. 1999.
The Non-Reversible Searcher Bar; http://www.searcherbar.com/a2-8.php; No date.
Better Barholing for Natural Gas Distribution Power Point Presentation; Funding in part by GTI Collaborative Project, NORA Apr. 2008.

* cited by examiner

*Primary Examiner*—Paul R Durand
(74) *Attorney, Agent, or Firm*—Andrus, Sceales, Starke & Sawall, LLP

(57) ABSTRACT

A slide hammer for driving a probe into the ground includes a probe lifting and removal arrangement in which a slide hammer tube is pivoted away from the probe to function as a lever operating with a clutch arrangement to incrementally withdraw the probe from the ground. A biasing arrangement using a coil spring is operative to hold the anvil in a locked probe driving position, to facilitate release of the tube from the locking position for pivotal movement to the probe removal position, to bias a clutch disk to a release position with respect to the pin, to facilitate incremental lifting contact between the clutch disk and the pin, and to return the tube to a subsequent incremental lifting position.

13 Claims, 5 Drawing Sheets

PROBE BAR HOLE DRIVER AND REMOVER

BACKGROUND OF THE INVENTION

The present invention pertains to an apparatus for driving a long narrow probe into the ground to assist in the location of leaks in natural gas pipelines. The probes have a number of different names including needle bar, pin, searcher bar, and plunger bar. The bar which is typically a ½ inch-⅝ inch steel rod is driven into the ground using a slide hammer to a depth of about 3 feet or more. The needle or probe is then pulled out of the ground and the gas concentration in the hole is measured with a hand-held detector. By driving a number of holes and measuring the difference in gas concentration in each, utility personnel can determine the size and position of the leak more accurately and, therefore, minimize size and extent of an excavation needed to find and repair the leak.

Slide hammer operation may be undertaken by utility workers and others many times during the day and the activity is known to cause repetitive stress injury. More recently, it has been determined that removing or pulling the probe from the ground is more damaging than the probe driving operation. Removing the tool by typical current methods requires lifting the 10-15 lb. hammer against the force of gravity and, in addition, the impact of the weight against the probe on retraction tends to compress the spine of the worker, significantly increasing the likelihood of injury.

Probe pulling devices are known in the industry to eliminate the purely manual lift-to-remove technique. These devices are similar to a conventional fence post puller in which a long lever is pivoted on an axis close to a gripping jaw around the post that may be operated by hand or by foot. Utility workers do not favor these pullers because they are awkward and heavy and are difficult to carry along with the probe driver and gas analyzer.

Recently activity has been devoted to the development of a combined needle or probe driver and remover but, to date, no such device has found any significant industry acceptance.

SUMMARY OF THE INVENTION

In accordance with the present invention, a bar hole probe driver and remover are combined in a single tool that is simply operated and does not add significantly to the weight of a conventional slide hammer driver. The apparatus of the present invention utilizes a conventional bar hole probe driver construction in which an anvil is attached to the upper end of the probe and the anvil and probe are received in a slide hammer tube adapted to strike the anvil and drive the probe into the ground in response to axial downward driving movement applied manually to the hammer. A unique alignment, release and removal apparatus includes a housing that is pivotally attached to the lower end of the slide hammer tube and has an open interior for slidably receiving the pin. The open interior of the housing contains a biasing spring arrangement that is operative to provide several significant functions, namely, to hold the anvil in the lower end of the slide hammer tube to lock and align the tube and the housing interior in a probe driving position; to release the tube from locked alignment with the housing permitting pivotal movement of the tube to a probe removal position relative to the housing (and releasing the housing to drop with the tube to the ground); to bias a clutch disk in the housing to a release position with respect to the pin; to facilitate incremental lifting contact between a tube extension bracket and the clutch disk to cock the disk into lifting engagement with the pin; and to return the tube to a next lifting contact position.

In a preferred embodiment, the housing interior is generally cylindrical and coaxial with the slide hammer tube in the probe driving position. The biasing spring arrangement preferably comprises a coil spring that surrounds the probe and is retained in the housing interior in a substantially uncompressed state in the probe driving position between a shoulder in the bottom of the housing and a closure arrangement at the top of the housing. The clutch disk comprises a bottom washer that is positioned between the housing bottom shoulder and the lower end of the coil spring. The closure arrangement includes a top washer on the upper end of the spring, a retainer ring that overlies the top washer, and a locking ring that engages the housing interior above the retainer ring.

The tube extension bracket preferably comprises a lever bracket that extends axially and laterally away from the end of the slide hammer tube and has a tooth on a free opposite end adapted to engage the clutch disk. The pivotal attachment of the lever bracket to the tube includes a pair of clevis plates attached to the outside of the housing and defining therebetween a slot for the lever bracket. A horizontally disposed pivot pin attaches the lever bracket to the clevis plates and a vertical slot in the housing wall between the clevis plates provides an opening for the free end of the lever bracket to permit the tooth to engage the clutch disk in response to lever bracket rotation.

In a presently preferred embodiment, the shoulder at the bottom of the housing is frustoconical and converges downwardly to define a vertical bore for maintaining alignment of the pin. The complete biasing arrangement includes the bottom washer (or clutch disk) resting on the shoulder, the coil spring, and an anvil stop which prevents the probe and anvil from dropping vertically through the housing. Or, stated another way, the anvil stop limits upward movement of the housing with respect to the pin. The anvil stop may comprise a top washer identical to the bottom washer. The spring biasing arrangement is completed with a retainer ring above the top washer seated on a housing top shoulder that is defined by a counter bore in the housing, and a snap ring that is seated in a groove in the housing above the retainer ring.

Instead of a single clutch disk washer, a plurality of stacked washers may be used. The apparatus is quickly and easily converted from the probe driving position to the probe removing position. In the driving position with the upper end of the anvil extending into the bottom end of the slide hammer tube, upward lifting of the housing against the force holding the probe in the ground will cause the housing to move vertically upwardly causing the anvil to be withdrawn from the slide hammer tube. The tube may then pivot with the lever bracket away from the anvil and down toward the probe removing position. In this position, the entire assembly of the housing, lever bracket and tube is released to slide downwardly along the probe to the ground. With downward rotation of the bracket and tube, the tooth at the end of the pivot bracket moves through the slot in the housing and into engagement with the clutch disk upon continued downward rotation of the lever bracket and tube. Normally, the clutch disk is biased to a contact release position with respect to the probe but, when it is desired to remove the probe from the ground, the lever bracket tooth is caused to engage and cock the clutch disk into engagement with the pin. Continued downward rotation of the lever bracket and tube causes the engaged clutch to pull the probe out of the ground by an incremental amount. Release of the lever bracket will cause the bias spring to return the toothed end of the lever bracket downwardly, releasing the engagement of the disk with the pin, and returning the lever bracket and tube to an upper lifting contact position.

When the probe has been pulled vertically upward to a position where it can be easily removed manually from the hole, a lever bracket and tube are pivoted upwardly until the tube end engages a chamfered surface on the upper end of the anvil, permitting the end of the tube to override the anvil and press it downwardly against the bias of the coil spring. After the tube has cleared the anvil, the spring returns the anvil to its uppermost locking position within the lower end of the tube.

DETAILED DESCRIPTION OF THE INVENTION

Figures 1, 2:
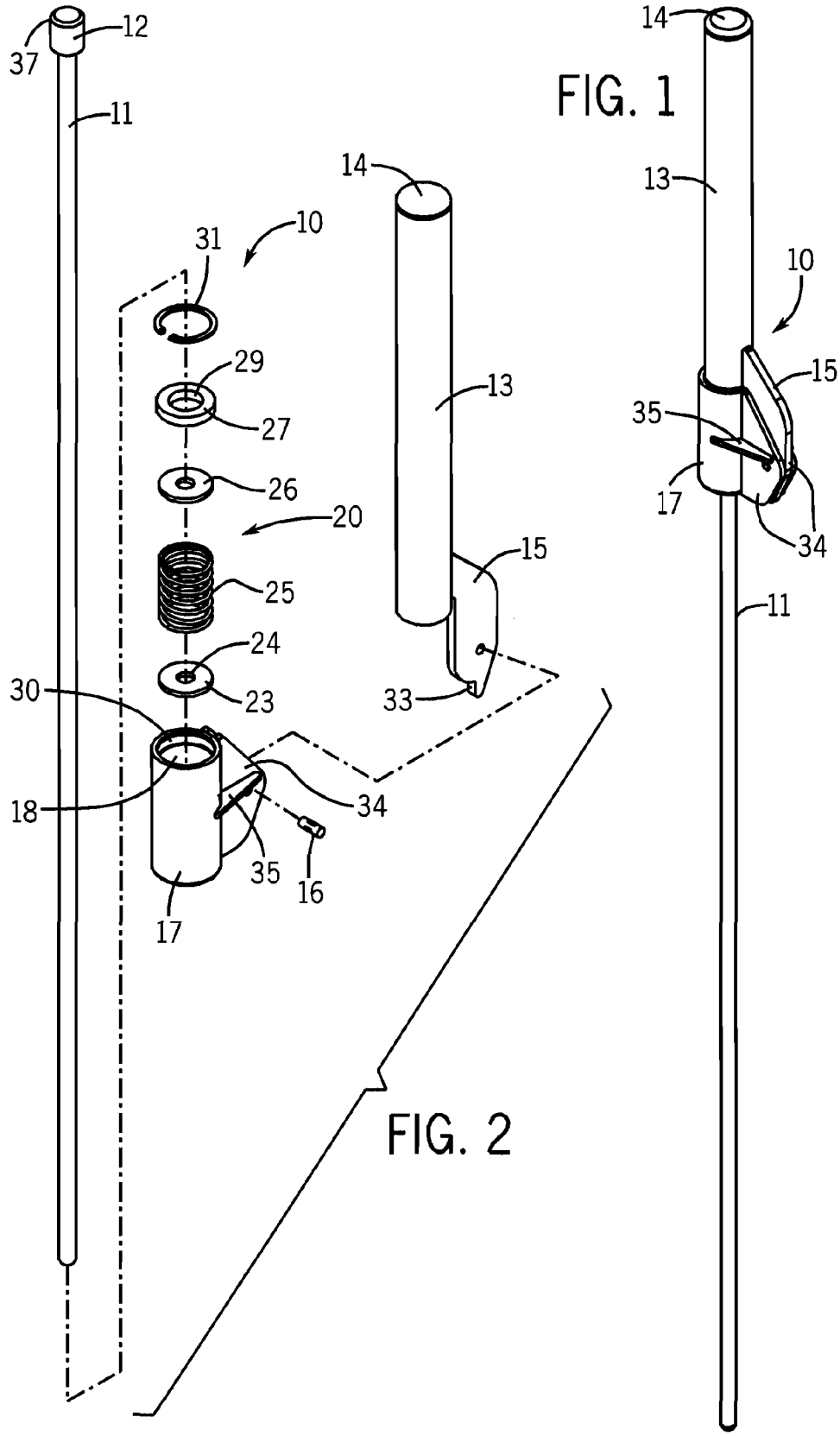
FIG. 1 is a perspective view of a probe driving and removing apparatus of the present invention.
FIG. 2 is an exploded view of the apparatus shown in FIG. 1.
Figure 5:
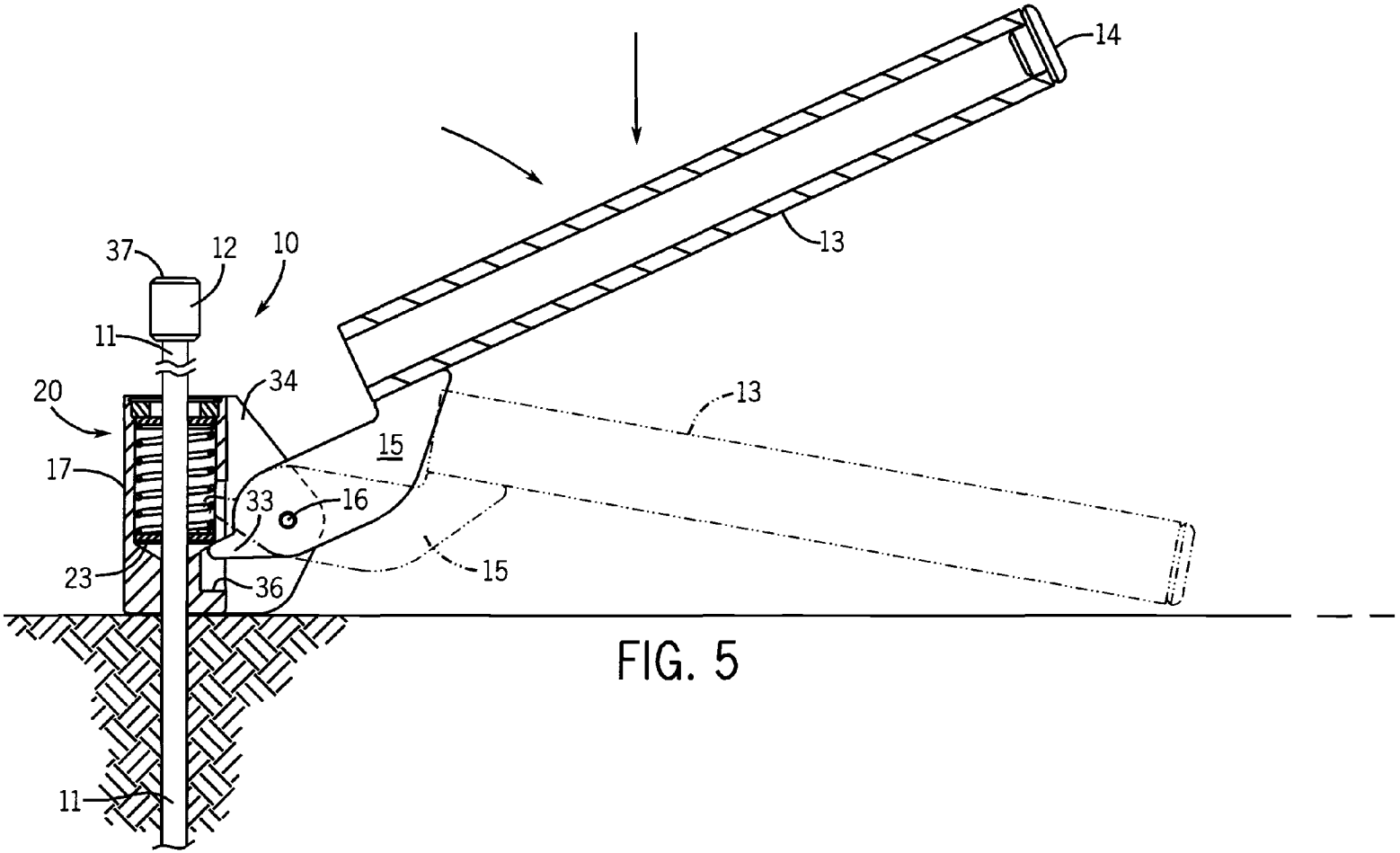
FIG. 5 is a sectional side elevation of the apparatus shown in FIG. 4 rotated to its operative position for probe removal.

In FIG. 1, there is shown an assembly of a probe driving and removing apparatus 10 of the present invention. The apparatus is used to drive a so-called needle bar or probe 11 into the ground and then to withdraw the probe to permit the concentration of leaking gas in the hole to be determined. Referring also to FIG. 2, the probe has a solid steel body and may be, for example, ⅝ inch (15 mm) in diameter. A larger diameter anvil 12 is attached to the top of the probe and is received in a cylindrical tube 13 of the slide hammer. The probe and anvil 12 slide freely in the tube 13, but the top end of the tube is closed by an end cap 14. In use, the operator raises the tube and cap vertically along the anvil and probe and then brings it vertically downwardly causing the cap 14 to strike the anvil 12 to drive the bottom end of the probe 11 into the ground. Repeated hammering strokes are necessary to drive the probe to an adequate depth, e.g. 3 feet (about 1 m) deep. Typically, some length of the probe 11 will remain above the level of the ground (see FIG. 5).

The foregoing describes the construction and use of a conventional slide hammer. However, the present invention is directed to an improved apparatus for removing the probe from the hole in a manner that minimizes operator strain, fatigue and potential injury.

The lower end of the slide hammer tube 13 has a lever bracket 15 welded to the outside of the tube. The lever bracket 15 extends laterally and downwardly from the lower end of the tube 13 and is pivotally connected to a lower lifter housing 17 with a horizontally disposed pivot pin 16.

Figure 3:
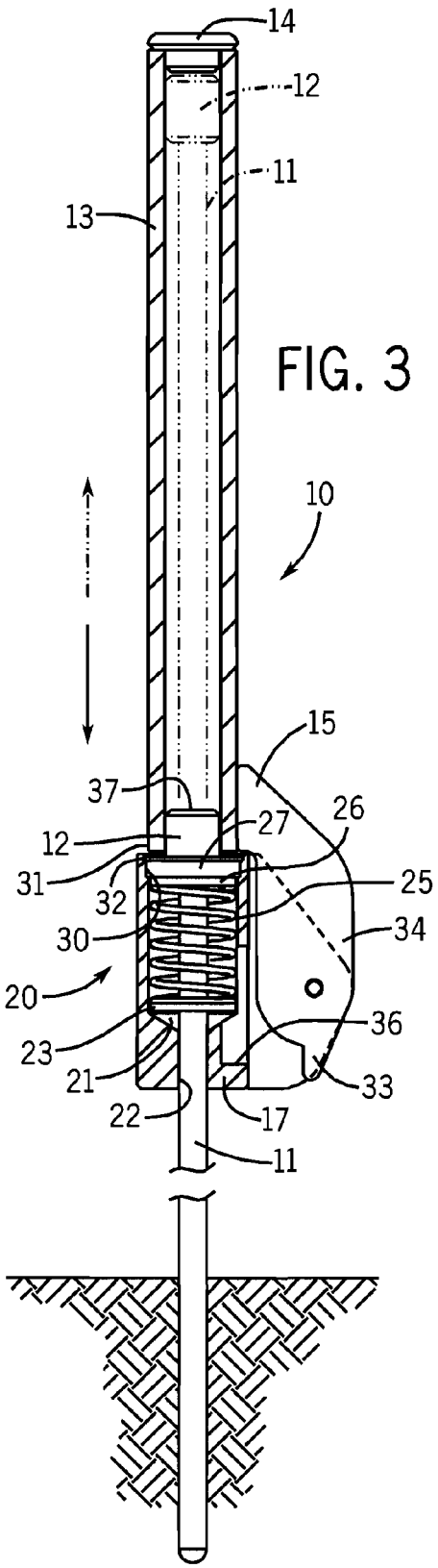
FIG. 3 is a sectional view of the apparatus shown in FIG. 2 in the operative driving position.
Figure 4:
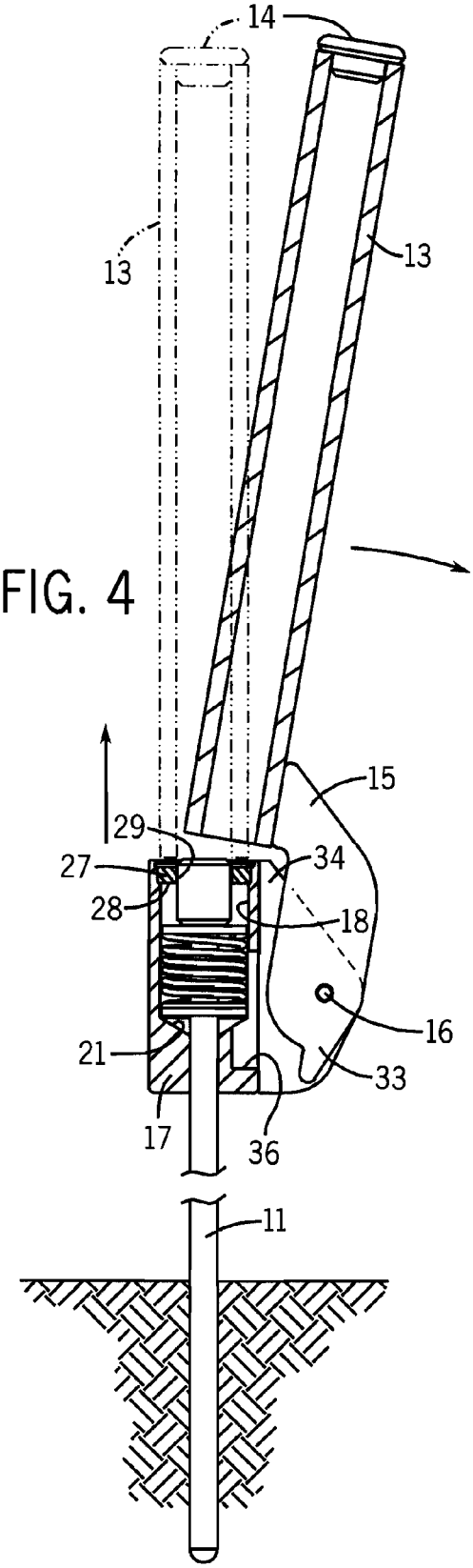
FIG. 4 is a sectional view, similar to FIG. 3, showing the initial conversion of the apparatus from the probe driving position to the probe removing position.

Referring also to FIGS. 3 and 4, the lifter housing 17 has a generally cylindrical inner wall 18 for mounting a biasing arrangement that provides several significant functions. In the probe driving position of FIG. 3, the lifter housing 17 is aligned with the slide hammer tube 13 such that the tube 13, probe 11 and cylindrical inner wall 18 of the housing are coaxially aligned. The biasing arrangement 20 is contained in the housing 17. The housing includes a shoulder 21 at the bottom of the cylindrical inner wall 18 which, in the embodiment shown, is frustoconical in shape, but it could be flat as well. The shoulder 21 converges downwardly and defines at its lower end a vertical bore 22 to help maintain alignment of the pin 16 as it passes therethrough. The biasing arrangement comprises, from the lower shoulder 21 upwardly, a lower washer 23, supported on the shoulder 21 and having a circular axial opening slightly larger than the diameter of the pin 16, such that in the probe driving position shown in FIG. 3, the washer is horizontal and probe movement therethrough is unrestricted. The biasing spring, in the form of a coil spring 25, rests atop the lower washer 23 and surrounds the probe on the interior of the lifter housing 17. An upper washer 26, which is preferably identical to the lower washer 23, rests on top of the upper end of the coil spring 25. A retainer ring 27 is seated on an upper shoulder 28 defined by a counterbore 30 at the upper end of the cylindrical inner wall 18 of the housing 17. The biasing arrangement is held within the housing by a snap ring 31 held in a groove 32 at the upper end of the counter bore 30.

The probe 11 and anvil 12 can slide freely within the slide hammer tube 13 between an upper position in which the anvil 12 is engaged by the end cap 14 and a lowermost position in which the anvil 12 passes partially through the center hole 29 in the retainer ring 27 and engages and is supported on the upper washer 26. In this position, shown in FIG. 3, the anvil 12 protrudes upwardly past the upper end of the housing 17 and a short distance into the bottom end of the tube 13. This is the aligned driving position in which the tube 13 and housing 17 slide together in reciprocal movement for driving the probe and anvil 11, 12. Thus, at the upper end of the driving stroke of the tube/housing assembly 13, 17, the anvil 12 is resting on and supported by the upper washer 26. In the lowermost position, where probe driving contact occurs, the anvil 12 is engaged by the cap 14 at the upper end of the tube 13.

When the probe has been driven a sufficient distance into the ground, the tube 13 and attached lever bracket 15 are pivoted on pivot pin 16 to rotate away from the lifter housing 17 to a probe removal position, as will be explained in greater detail below. Initially, however, the slide hammer tube 13 must be released from alignment with the housing and locking engagement by the anvil 12. To unlock the tube 13, the operator slides the interconnected tube and housing vertically upwardly until the anvil 12 engages the upper washer 26. A slight continued upward motion against the bias of the coil spring 25 causes the spring to compress and the anvil 12 to be withdrawn from the tube 13 as shown in FIG. 4, whereby the tube and lever bracket 15 are free to pivot away from the lifter housing 17. Once the tube has been separated from the housing, and pivoted away from the anvil 12 and probe 11, housing 17, along with the lever bracket and tube, are free to slide downwardly along the probe and onto the surface of the ground. This establishes the probe removing position of the tool shown in FIG. 5.

Figure 6:
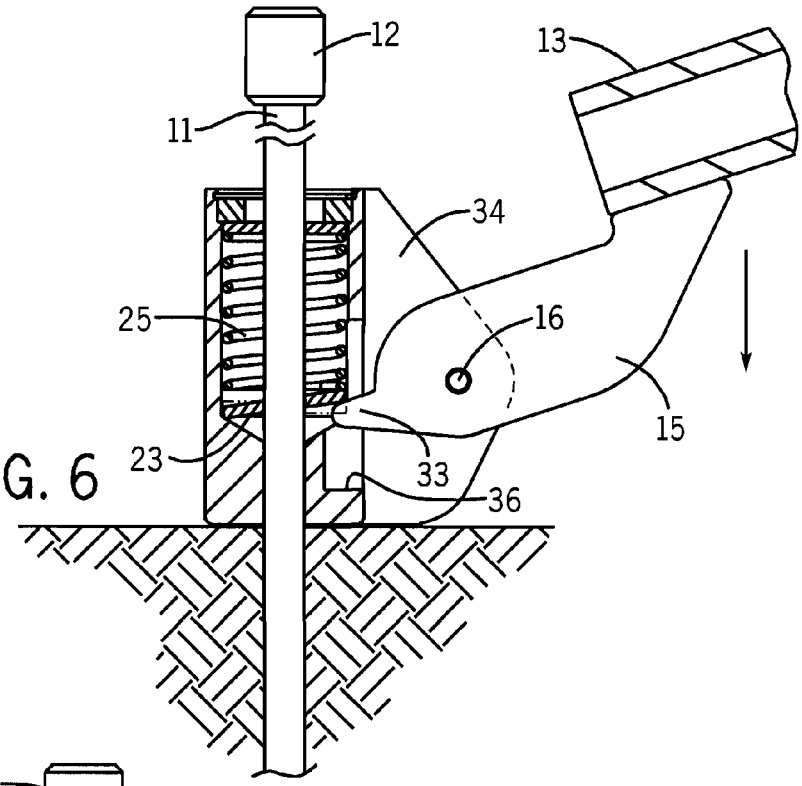
FIGS. 6 and 7 are enlarged sectional details showing incremental movement of the probe in the probe removal stroke of the apparatus.
Figure 7:
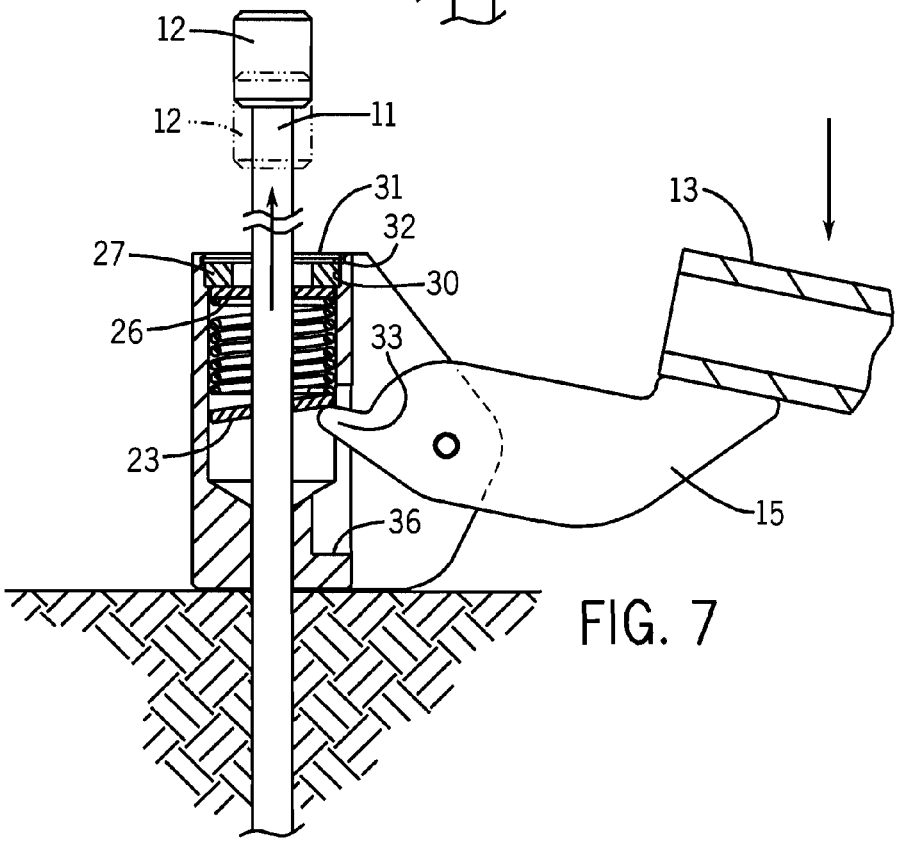

The lower end of the lever bracket 15, opposite the bracket connection to the tube, is provided with a tooth 33. The lever bracket is pivotally mounted on a pivot pin 16 between a pair of parallel clevis plates 34 that are attached to the outside of the lifter housing 17. The clevis plates may be reinforced with gussets 35 welded to the housing and to the clevis plates 34. Between the clevis plates, the housing is provided with a narrow vertical slot 36 which is open to the interior of the housing and is just wide enough to receive the end of the lever bracket and tooth 33 as the lever bracket and tube are pivoted downwardly. As the tooth 33 enters the slot 36, it engages one edge of the lower washer 23 (see FIG. 6) and, with continued rotation, cocks the washer out of its coaxial alignment with the probe 11 and causing the inner peripheral edge of the washer to engage and grip the probe (see FIG. 7). Upward rotation of the tooth in engagement with the washer 23 causes the probe to be lifted vertically and incrementally out of the ground and upwardly within the interior of the housing 17. The incremental movement of the lower washer and captured probe may be in the order of 1-1.5 inches (25-38 mm). This probe removing motion is easily and comfortably applied by the foot or the hand of the operator, the length of the tube 13 providing a good mechanical advantage. When the incremental stroke is complete and the operator releases the pressure on the tube 13, the bias of the coil spring 25 realigns the lower washer 23 so it can slide downwardly in the interior 18 of the housing 17 and into engagement with shoulder 21. This return biasing force also applies a downward force on the lever bracket tooth 33 to assist the upward pivotal return of the bracket and attached tube 13 into a position ready for downward movement for the next incremental removal stroke. The process is repeated, with the peripheral interior edge of the washer engaging the probe in the manner of a clutch mechanism, until the probe has been pulled vertically upwardly to a position where it can be easily removed from the hole.

It should be noted that, although the washer 23 is shown as a common circular washer with a circular hole, other shapes of clutch disks could be used as well. For example, the outer edge of the disk could be square, rectangular, or some other shape, and the interior hole could be a shape other than round. Ordinary circular washers are, however, preferred.

The same probe 11 may be used to form the next bore hole, but if necessary because of damage, the probe is easily withdrawn through the biasing arrangement and out of the lifter housing 17. To prepare the apparatus for driving the probe into the next hole, the lever bracket 15 and attached tube 13 are pivoted upwardly around the pivot pin 16 until the lower edge of the tube 13 engages the upper end of the anvil 12 which is resting and retained on the upper washer 26. The upper end of the anvil 12 is provided with a chamfer 37 that assists in causing the tube end to override the anvil whereupon the upward bias of the coil spring 25 pushes the anvil 12 into the lower end of the tube to the aligned and locked probe driving position of FIG. 3.

For servicing and maintenance, the biasing arrangement 20 is readily accessed. After the snap ring 31 is removed, all of the remaining components of the biasing arrangement may be easily slid upwardly out of the lifter housing 17. If the lower washer becomes worn, it can be easily replaced. If the upper washer 26 is identical to the lower washer, their positions may be switched to, in effect, provide the clutch arrangement with a new washer. Also, a plurality of stacked lower washers 23 can also be used in which case the clutching force of the washers may be distributed and wear reduced considerably.

Figure 8:
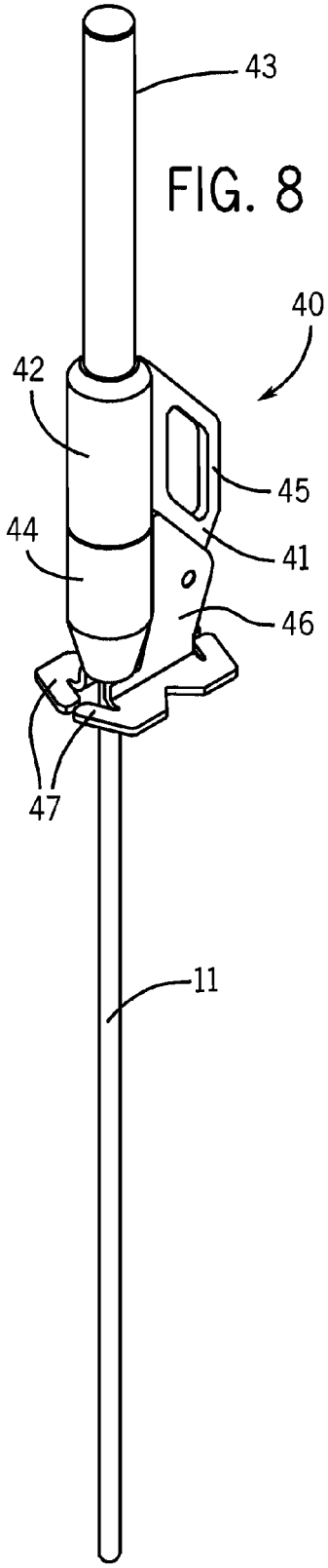
FIG. 8 is a perspective view of an alternate embodiment of the apparatus shown in FIG. 1.
Figure 9:
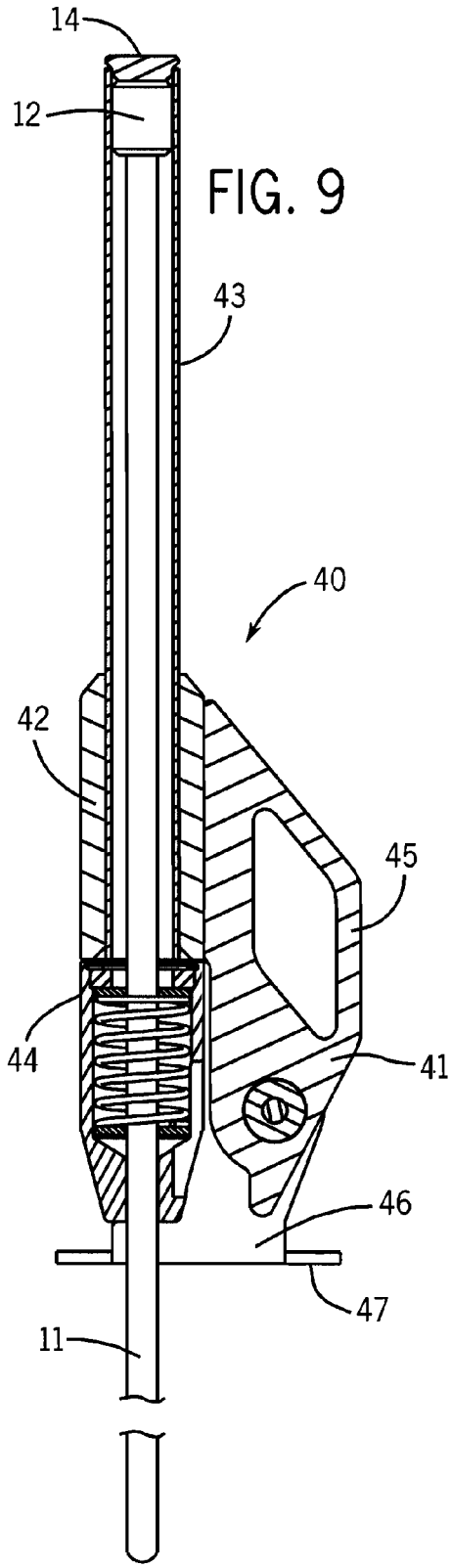
FIG. 9 is a sectional elevation through the embodiment of the apparatus shown in FIG. 8.

A modified embodiment of the apparatus 40 is shown in FIGS. 8 and 9. In this arrangement, the lever bracket 41 has a sleeve 42 that surrounds the slide hammer tube 43 and is secured thereto. In the extraction operation shown, the sleeve, which has a diameter that corresponds to the outside diameter of the lifter housing 44, provides a weight distribution with more mass closer to the pivot. This permits the use of a lighter spring 25 to return the lever bracket and tube upwardly to the position for the next incremental down stroke. A handle 45 is incorporated into the lever bracket 41 to facilitate carrying. Also, the clevis plates 46 may be extended to define a lower ground-engaging flange 47. The flange 47 provides an enlarged "foot print" so that during extracting operation, there is better support for the housing 44, particularly in soft or loose soils.

I claim:

1. In an apparatus for driving and removing a probe into and out of the ground, the probe having an anvil attached to the upper end; and, a slide hammer having a tube sized to slidably receive the anvil and probe for axial movement therein and a cap closing the upper end of the tube, the cap adapted to strike the anvil in response to axial downward driving movement of the slide hammer along the pin;

an improved release and probe removing arrangement comprising:

a lifter housing attached to the lower end of the tube, the lifter housing having an open interior defining an axial through passage sized to permit the probe to slide axially therein, and an anvil stop at the upper end of the passage sized to engage the anvil and limit upward movement of the housing with respect to the pin;

an intermediate hinge arrangement including a lever bracket fixed at an upper end to the tube and pivotally attached at a lower bracket end to the lifter housing for pivotal movement of the bracket and tube on a horizontal axis;

a biasing arrangement in the lifter housing interior including a spring captured between a shoulder in the bottom of the housing interior and the underside of the anvil stop, the spring being operative to bias the anvil upwardly into the lower end of the slide hammer tube to lock the tube to the housing, the anvil and probe adapted to move downwardly within the housing and against the spring bias in response to a manual upward lifting force applied to the housing and the tube to cause withdrawal of the anvil from the tube to permit the lever bracket and tube to pivot out of alignment with the housing, and to release the housing to drop with the lever bracket and tube along the probe to the ground;

the biasing arrangement further including a pin-engaging clutch comprising a bottom washer surrounding the probe and captured between the lifter housing shoulder and the spring, the washer held in a non-engaging position permitting the probe to move axially within the housing interior, the washer being movable against the spring bias to a cocked pin-engaging position;

the lever bracket having a washer-engaging tooth adapted to pass into the housing interior in response to pivotal downward movement of the bracket to engage an edge of the washer to move the washer to the pin-engaging position such that continued downward rotation of the bracket lifts the probe axially from the ground with respect to the housing and release of the bracket from downward rotation permits the spring bias to cause reverse rotation of the bracket and to return the washer to the non-engaging position.

2. The apparatus as set forth in claim 1 wherein the interior of the lifter housing is cylindrical, the bottom shoulder defines a vertical bore for maintaining alignment of the pin, and the biasing arrangement comprises, in vertical upward order, the bottom washer, the spring and the anvil stop comprising a top washer; and, the biasing arrangement held in place by a retainer ring seated on a housing top shoulder defined by a housing counterbore above the top washer, and a demountable locking ring seated in a groove in the housing above the retainer ring.

3. The apparatus as set forth in claim 2 wherein the bottom shoulder is one of frustoconical and flat and extends between the cylindrical interior of the housing and the vertical alignment bore.

4. The apparatus as set forth in claim 2 wherein the bottom and top washers are identical.

5. The apparatus as set forth in claim 2 wherein the spring is a coil spring.

6. The apparatus as set froth in claim 2 comprising a plurality of stacked bottom washers.

7. The apparatus as set forth in claim 1 wherein the lever bracket is fixed to the outside of the tube at the lower end thereof;

the probe anvil having a chamfered circular upper end adapted to be engaged and overridden by the lower end of the tube in response to upward rotation of the lever bracket and tube, whereby the anvil is pressed downwardly with respect to the lifter housing against the spring bias and then returned to the locking position within the lower end of the tube.

8. The apparatus as set forth in claim 1 including a ground-engaging load distribution flange at the bottom of the housing.

9. The apparatus as set forth in claim 8 wherein the ground-engaging flange comprises separate integral extensions of the clevis plates.

10. The apparatus as set forth in claim 1 wherein the lever bracket includes an operator handle.

11. The apparatus as set forth in claim 10 wherein the lifter housing is generally cylindrical in shape and the tube includes an outer sleeve attached to its lower end, the sleeve having a cylindrical shape of the same diameter as the lifter housing.

12. The apparatus as set forth in claim 1 wherein the tube extension bracket comprises a lever bracket extending axially and laterally away from the end of the tube and having a tooth on a free opposite end for engaging the clutch disk;

the pivotal attachment of the lever bracket to the tube including a pair of clevis plates attached to the outside of the housing and defining therebetween a slot for the lever bracket, a horizontally disposed pivot pin attaching the lever bracket to the clevis plates, the housing having a slot between the clevis plates providing an opening for the free end of the lever bracket to permit the tooth to engage the clutch disk in response to lever bracket rotation.

13. A lock, release and removal apparatus for a bar hole probe driver of the type in which an anvil is attached to the upper end of the pin, and the anvil and probe are received in a tube of a slide hammer adapted to strike the anvil and drive the probe into the ground in response to axial downward driving movement applied manually to the slide hammer, the apparatus comprising:

a housing pivotally attached to the lower end of the tube, the housing having an open interior for slidable receipt of the probe and mounting a biasing spring arrangement operative (1) to hold the anvil in the lower end of the slide hammer tube to lock and align the tube and the housing interior in a probe driving position, (2) to release the tube from locked alignment and permit pivotal movement of the tube to a probe removal position relative to the housing, (3) to bias a clutch disk in the housing to a release position with respect to the pin, and (4) to return the tube to a next lifting contact position; and, wherein the biasing spring arrangement comprises:

a coil spring surrounding the probe and retained in the housing interior in a slightly compressed state in the probe driving position between a shoulder in the bottom of the housing and a closure arrangement at the top of the housing;

the clutch disk comprises a bottom washer positioned between the housing bottom shoulder and the lower end of the coil spring; and, the closure arrangement comprising a top washer on the upper end of the spring, a retainer ring overlying the top washer, and a locking ring engaging the housing interior above the retainer ring.

* * * * *